United States Patent [19]

Hund, Jr.

[11] Patent Number: 4,665,649

[45] Date of Patent: May 19, 1987

[54] GATE OPERATOR AND LATCH MECHANISM FOR REFUSE CONTAINER

[75] Inventor: Henry M. Hund, Jr., Knoxville, Tenn.

[73] Assignees: Dempster Systems Inc.; Southern Railway, both of Knoxville, Tenn.

[21] Appl. No.: 731,064

[22] Filed: May 6, 1985

[51] Int. Cl.[4] ..... E05F 15/00

[52] U.S. Cl. ..... 49/280; 298/23 S

[58] Field of Search ..... 298/23 M, 23 MD, 23 S; 49/280, 300; 296/56, 100, 101

[56] References Cited

U.S. PATENT DOCUMENTS 3,272,552 9/1966 Park ..... 298/23 MD
4,307,541 12/1981 Farmer ..... 298/23 S

FOREIGN PATENT DOCUMENTS 557701 9/1931 Fed. Rep. of Germany .... 298/23 S
2345597 3/1975 Fed. Rep. of Germany .... 298/23 S
876349 8/1961 United Kingdom ..... 298/23 S

*Primary Examiner*—Kenneth J. Dorner
*Assistant Examiner*—Gerald A. Anderson
*Attorney, Agent, or Firm*—Jacox & Meckstroth

[57] ABSTRACT

Gate operator and latch mechanism in which a refuse container is provided with a gate which is pivotally attached to the refuse container and which normally closes an opening through which refuse is discharged from the refuse container. A latch mechanism secures the gate in closed position. The operator mechansim is operably joined to the gate for pivotal movement thereof. The operation mechanism is also operably joined to the latch mechanism for operation thereof.

10 Claims, 5 Drawing Figures

GATE OPERATOR AND LATCH MECHANISM FOR REFUSE CONTAINER

BACKGROUND OF THE INVENTION

This invention pertains to a refuse container which is provided with a pivotally mounted gate which closes an opening from which refuse is discharged from the container. This invention also pertains to a latch mechanism which secures the gate in closed position and operator mechanism which operates the gate and which also operates the latch mechanism.

An object of this invention is to provide operator mechanism which moves a gate of a refuse container between closed position and an open position. The operator mechanism also operates a latch mechanism which functions to secure the gate in closed position and in which the latch mechanism is operable to release the gate to permit the gate to be opened.

Another object of this invention is to provide such operator mechanism which is capable of applying a high degree of force to a latch mechanism for closing the gate and for latching the gate.

Another object of this invention is to provide such a latch mechanism in which the latching forces automatically increase as internal opening pressure is applied upon the gate.

Another object of this invention is to provide such operator mechanism which is capable of relatively large magnitudes of work in consideration of the physical size of the mechanism.

Other objects and advantages of this invention reside in the construction of parts, the combination thereof, the method of construction and the mode of operation, as will become more apparent from the following description.

SUMMARY OF THE INVENTION

Gate operator and latch mechanism of this invention comprises a linearly operable fluid motor which is operably joined to a gate for pivotal movement of the gate and which is also operably joined to latch mechanism for latching and unlatching the gate.

DETAILED DESCRIPTION OF THE INVENTION

Figure 1:
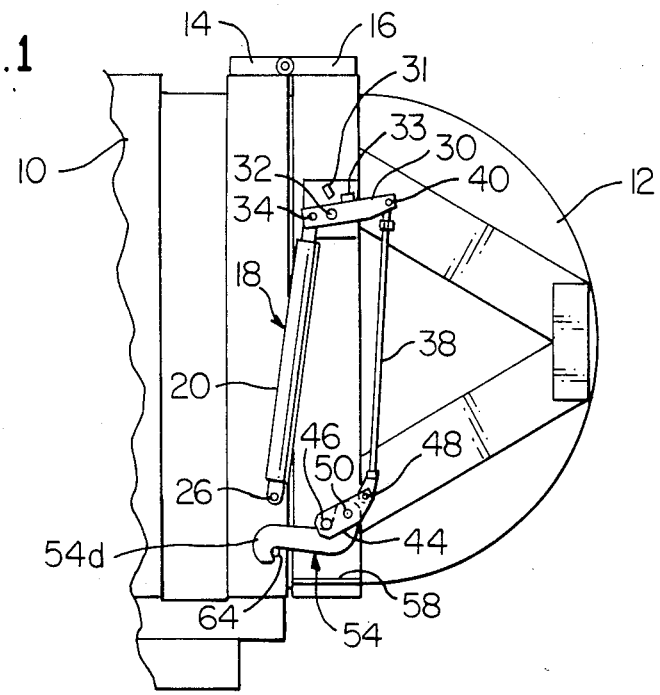
FIG. 1 is a fragmentary side elevational view showing a portion of a refuse container provided with a gate. This view also shows a gate operator and latch mechanism of this invention. This figure shows the gate in closed and latched condition.

FIG. 1 shows a portion of a refuse container 10 which is provided with a gate or closure member 12. Hinge elements 14 and 16 at the upper portion of the refuse container 10 and at the upper portion of the gate 12 hingedly attach the gate 12 to the refuse container 10. An elongate linearly operable fluid motor 18 has a housing 20 and an actuator rod 22. The housing 20 is pivotally attached to the lower portion of the refuse container 10 by means of a pin 26. A lever 30 is pivotally attached to the upper portion of the gate 12 by means of a pin 32, which is intermediate the ends of the lever 30. Adjacent the lever 30 is a limit member 31 and a limit member 33, which are engageable by the lever 30 to limit the pivotal movement thereof. When the gate 12 is completely closed, the lever 30 is in engagement with the limit member 33, as shown in FIG. 1.

The actuator rod 22 of the fluid motor 18 is pivotally attached to an end portion of the lever 30 by means of a pin 34. A rigid arm 38 has an upper end portion pivotally attached to the opposite end portion of the lever 30 by means of a pin 40.

A link 44 is pivotally attached to the lower portion of the gate 12 by means of a pin 46. The rigid arm 38 has a lower end portion which is pivotally attached to the link 44 by means of a pin 48. Pivotally attached to the link 44 by means of a pin 50 is a latch 54. The pin 50 is intermediate the ends of the link 44 and is between the pin 46 and the pin 48. The latch 54 has a connection portion **54*a* which is joined to the pin 50. The latch 54 also has a main portion 54*b*, which is angular with respect to the connection portion 54*a*. At the juncture of the main portion 54*b* and the connection portion 54*a* the latch 54 has an abutment portion 54*c* which is engageable with the pin 46 which extends axially from the surface of the gate 12. The latch 54 also has a hook end portion 54*d***.

At the lower portion of the gate 12 below the latch 54 is an engagement surface 58, which is engageable by the lower surface of the latch 54, with pivotal movement of the latch 54.

At the lower portion of the refuse container 10 is a latch pin 64.

It is to be understood that the structure shown in the drawings and discussed herein constitutes one side of the structure. Similar structure and mechanism are positioned on the opposite side of the refuse container 10 and the gate 12, and the operation of the mechanism is the same as to the operation of the mechanism shown and described.

Operation

FIG. 1 shows the gate 12 in closed position with respect to the refuse container 10. This figure also shows the latch 54 in latched position. The hook end portion **54*d* of the latch 54 is in firm engagement with the latch pin 64. The actuator rod 22 of the fluid motor 18 is positioned substantially entirely within the housing 20. The lever 30 is pivoted in its maximum counter clockwise position, as the lever 30 engages the limit member 33, as shown in FIG. 1. Thus, the arm 38 and the link 44 are in the upper positions thereof. The connection portion 54*a* of the latch 54 is in the upper position thereof. In this position of the latch 54, the pin 46 which extends axially from the surface of the gate 12, is engaged by the abutment portion 54*c* of the latch 54**.

When it is desired to discharge refuse from the refuse container 10, the gate 12 is pivotally moved upwardly. To pivotally move the gate 12, the fluid motor 18 is operated. The actuator rod 22 of the fluid motor 18 is moved in a direction from the housing 20. The actuator rod 22 thus applies a force upon the lever 30. This force pivotally moves the lever 30 in a clockwise direction, as viewed in FIGS. 1 and 2. This pivotal movement of the lever 30 forces the arm 38 to move generally axially downwardly. Downward movement of the arm 38 causes pivotal movement of the link 44 in a clockwise direction, as viewed in FIGS. 1 and 2. This pivotal movement of the link 44 about the pin 46 forces the connection portion 54*a* of the latch 54 downwardly.

As the connection portion 54*a* of the latch 54 moves downwardly, the lower part of the latch 54 engages the engagement surface 58. Thus, the hook end portion 54*d* of the latch 54 is moved upwardly as the connection portion 54*a* of the latch 54 moves downwardly. As the hook end portion 54*d* of the latch 54 moves upwardly, the hook end portion 54*d* of the latch 54 moves away from the latch pin 64. Thus, the gate 12 is free to pivotally move upwardly.

Figure 2:
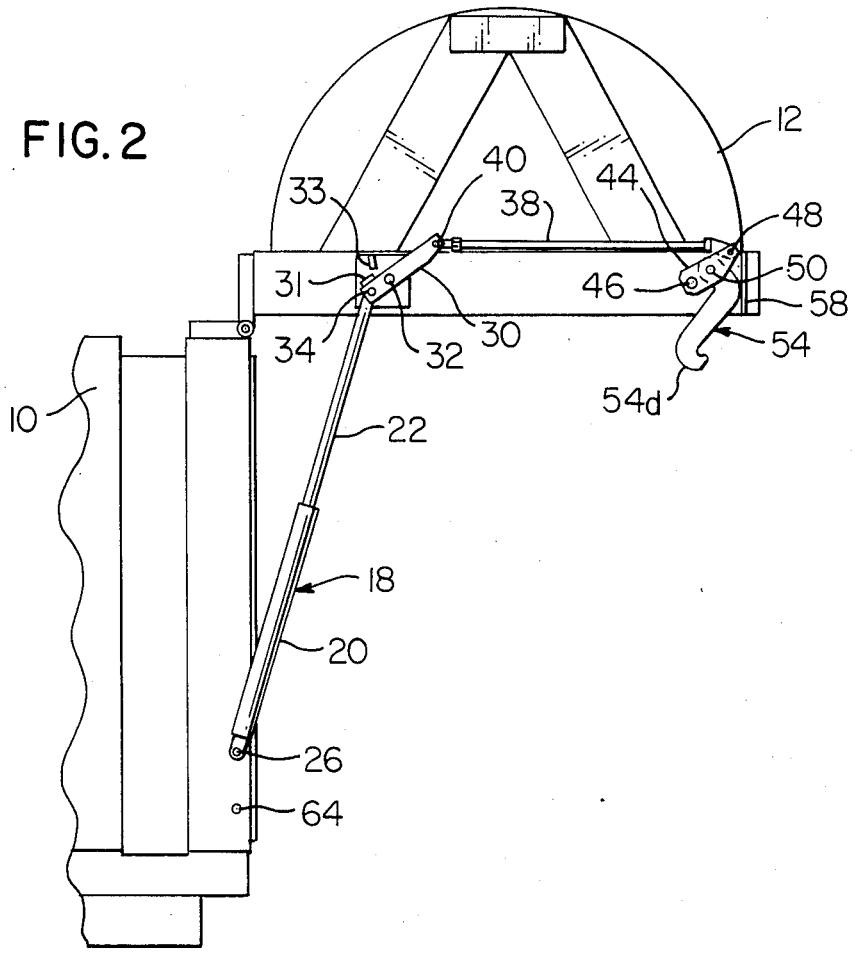
FIG. 2 is a fragmentary side view, similar to FIG. 1, showing the gate in an open position.

Continued upward travel of the actuator rod 22 with respect to the housing 20 applies greater force upon the lever 30. The lever 30 is pivotally moved into engagement with the limit member 31, and there is no additional pivotal movement of the lever 30. However, due to the fact that the lever 30 is attached to the gate 12, continued force upon the lever 30 forces the gate 12 to pivotally move upwardly as the actuator rod 22 travels upwardly. Thus, the gate 12 is moved to an open position as shown in FIG. 2. Thus, the contents of the refuse container 10 can be discharged therefrom.

When it is desired to close the gate 12, the fluid motor 18 is operated to move the actuator rod 22 downwardly and toward the housing 20. This downward movement of the actuator rod 22 moves the lever 30 downwardly without pivotal movement of the lever 30. This downward movement of the actuator rod 22 permits the gate 12 to move pivotally downwardly. As the fluid motor 18 moves the gate 12 pivotally downwardly, the lever 30 is pivotally moved in a counterclockwise direction. Thus, the arm 38 is moved upwardly, and the link 44 is pivotally moved upwardly. As the gate 12 pivotally moves downwardly the latch 54 is carried downwardly with pivotal downward movement of the gate 12, and the latch 54 moves toward the lower portion of the refuse container 10.

Figure 3:
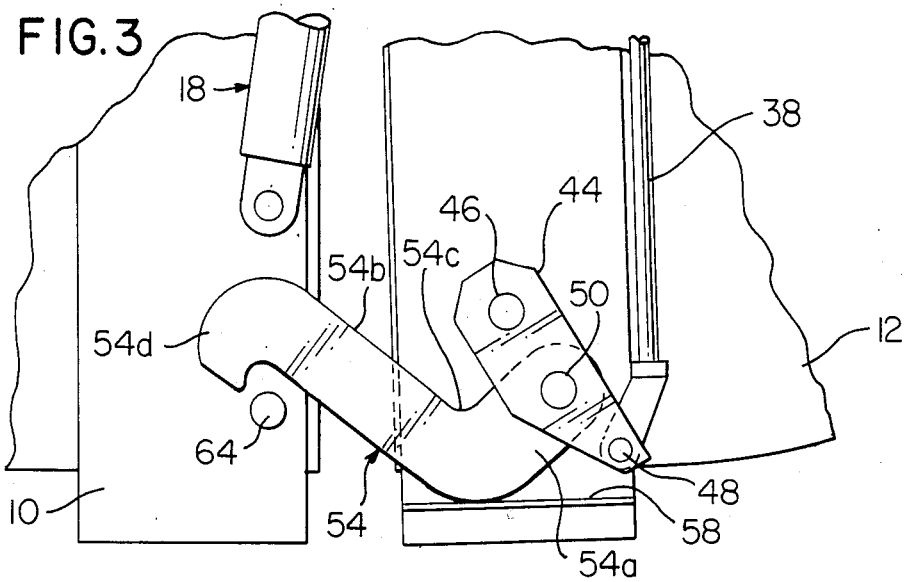
FIGS. 3, 4, and 5 fragmentary side elevational views, drawn on a larger scale than FIGS. 1 and 2 and illustrating operation of the latch mechanism as the gate pivotally moves adjacent the refuse container.
Figure 4:
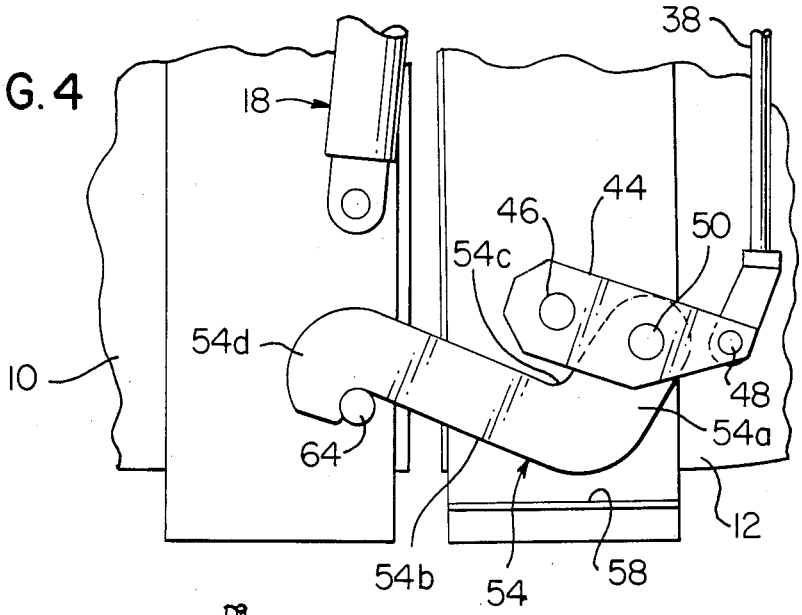
Figure 5:
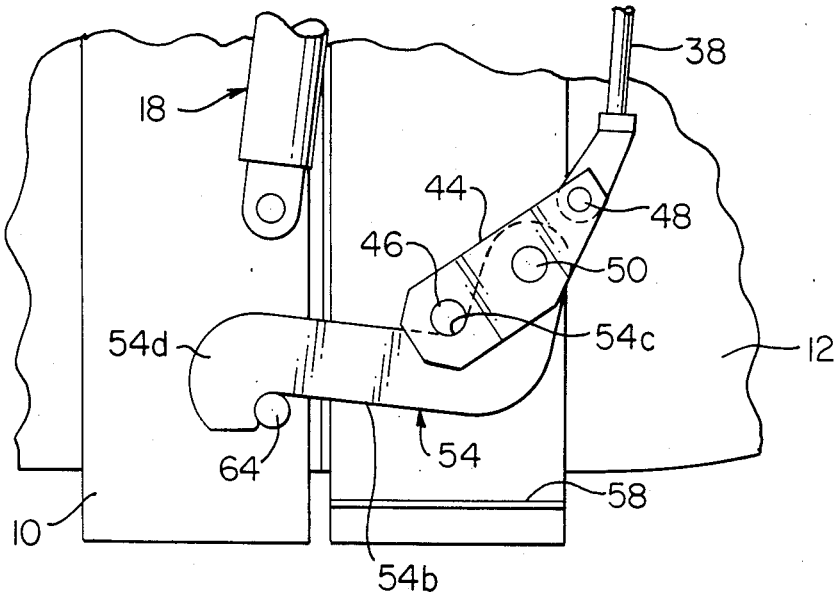

FIGS. 3, 4, and 5, illustrate operation of the latch 54 as the gate 12 pivotally approaches the refuse container 10. The connection portion 54*a* of the latch 54 is moved upwardly by upward pivotal movement of the link 44. As this upward movement of the connection portion 54*a* of the latch 54 occurs, the hook end portion 54*d* is moved downwardly, as the lower surface of the latch 54 moves in engagement with the engagement surface 58.

Thus, the latch 54 pivotally moves, and the hook end portion 54*d* is moved to a position above the latch pin 64, as shown in FIG. 3. As the hook end portion 54*d* approaches the latch pin 64, the abutment portion 54*c* of the latch 54 approaches the pin 46.

During this downward pivotal movement of the gate 12, the arm 38 is moving upwardly and pivotally moving the link 44 upwardly. The link 44 is moving the connection portion 54*a* of the latch 54 upwardly, and the hook portion 54*d* of the latch 54 moves downwardly and engages the latch pin 64, as shown in FIG. 4. However, at this position shown in FIG. 4, the gate 12 is not fully closed. Additional upward movement of the connection portion 54*a* of the latch 54 by upward movement of the link 44 results in movement of the abutment portion 54*c* into engagement with the pin 46. Thus, as the arm 38 is moved upwardly the latch 54 is pivotally moved about the pin 50 and into firm engagement with the latch pin 64. Thus, there is additional pivotal movement of the latch 54, and the lower portion of the gate 12 is drawn into secure firm engagement with the lower portion of the container 10, as illustrated in FIG. 5.

Due to the fact that the arm 38 through pivotal movement of the lever 30 is capable of exerting significant forces upon the link 44, the link 44 is capable of firm pivotal movement of the latch 54 about the pin 50 and about the engagement surface 58. Thus, a very significant force is applied to the latch 54 for drawing the lower portion of the gate 12 toward the lower portion of the refuse container 10. Thus, the gate 12 is firmly closed upon the refuse container 10. Also, it is to be noted that the pin 48 of the link 44 is above a centerline drawn through the pins 46 and 50 when the gate 12 is closed. Thus, an over center position exists in the link 44, and the latch 54 is maintained in firm engagement with the latch pin 64 when the arm 38 is maintained in its position shown in FIG. 1.

Thus, it is understood that the mechanism of this invention includes latch mechanism and also includes motor and linkage means for operation of the latch mechanism and for pivotal movement of the gate.

Although the preferred embodiment of the mechanism of this invention has been described, it will be understood that within the purview of this invention various changes may be made in the form, details, proportion and arrangement of parts, the combination thereof, and the mode of operation, which generally stated consist in a gate operator and latch mechanism within the scope of the appended claims.

The invention having thus been described, the following is claimed:

1. Gate operator and latch mechanism for a refuse container member provided with a pivotally mounted gate member, the gate member having an open position and a closed position with respect to the refuse container member, comprising:

motor means attached to one of the members, operator means pivotally attaching the motor means to the other member, a latch pin attached to one of the members, a link provided with a first connection portion and a second connection portion and a third connection portion, the second connection portion being positioned generally between the first connection portion and the third connection portion, the first connection portion of the link being pivotally attached to said other member and supported thereby, a latch provided with a connection portion and an engagement portion, the connection portion of the latch being pivotally attached to second connection portion of the link for pivotal movement of the latch with pivotal movement of the link, the latch being pivotally movable toward and away from said other member as the link is pivotally moved, and connector means joining the operator means to the third connection portion of the link for pivotal movement of the link and the latch with operation of the operator means and with operation of the motor means, wherein the latch is pivotally movable in a direction toward said other member and into engagement with the latch pin with pivotal movement of the link, and wherein the latch is further pivotally moved with additional pivotal movement of the link, and wherein such further movement of the latch forces the gate toward the refuse container to secure the gate member in closed position with respect to the refuse container.

2. Gate operator and latch mechanism for a refuse container provided with a pivotally mounted gate which has an open position and a closed position with respect to the refuse container, comprising:

motor means attached to the refuse container, operator means connecting the motor means to the gate for pivotal movement of the gate between an open position and a closed position with respect to the refuse container, a link provided with a first connection portion and a second connection portion and a third connection portion, the first connection portion of the link being pivotally attached to the gate, attachment means pivotally attached to the operator means and to the third connection portion of the link for pivotal movement of the link with operation of the operator means, a latch provided with a connection portion and an engagement portion, means pivotally connecting the connection portion of the latch to the second connection portion of the link for support of the latch by the link, a latch pin attached to the refuse container, wherein, as the gate approaches closed position the latch is moved with respect to the gate and moved with pivotal movement of the link and the engagement portion of the latch is moved into engagement with the latch pin, and wherein upon further pivotal movement of the link the latch is further pivotally moved with respect to the gate and the latch pivotally draws the gate toward the refuse container for latching the gate in closed position with respect to the refuse container.

3. Gate operator and latch mechanism for a refuse container which is provided with a gate which is pivotally attached to the refuse container, the gate being movable between a closed position and an open position, comprising:

a reciprocally operable motor pivotally attached to the refuse container, a lever, means pivotally attaching the reciprocally operable motor to the lever, means pivotally attaching the lever to the gate, a link, the link having a plurality of connection portions, pivot means pivotally attaching one of connection portions of the link to the gate for support of the link by the gate at a position spaced from the lever, a rigid arm, means pivotally joining the rigid arm to the lever, means pivotally joining the rigid arm to another connection portion of the link as the rigid arm extends between the lever and the link, a latch provided with a connection portion and an engagement portion, means pivotally attaching the connection portion of the latch to a connection portion of the link for support of the latch by the link, a latch pin attached to the refuse container, wherein the latch is pivotally moved by pivotal movement of the link for engagement of the engagement portion of the latch with the latch pin, wherein additional pivotal movement of the link forces additional pivotal movement of the latch about the latch pin for drawing the gate toward the refuse container and toward the latch pin for latching the gate in closed position.

4. The gate operator and latch mechanism of claim 3 in which the latch has an intermediate portion which is engageable with the pivot means for application of pressure by the latch upon the latch pin during the additional pivotal movement of the link.

5. Gate operator and latch mechanism for a refuse container which is provided with a gate which is pivotally movable between a closed position and an open position with respect to the refuse container, the refuse container having an upper portion and a lower portion, the gate having an upper portion and a lower portion, comprising:

a linearly operable fluid motor provided with a housing member and an actuator member, the housing member and the actuator member being relatively movable, means pivotally attaching one of the members of the fluid motor to the refuse container, a lever, the lever having a first connection part and a second connection part, the lever having an intermediate part between the first connection part and the second connection part, means pivotally attaching the intermediate part of the lever to the upper portion of the gate, means pivotally joining the other member of the fluid motor to the first connection part of the lever, an arm, means pivotally joining the arm to the second connection part of the lever, a link provided with a plurality of spaced-apart connection portions, there being a first connection portion and a second connection portion, there being an intermediate connection portion which is generally between the first connection portion and the second connection portion, the first connection portion of the link being pivotally attached to the gate, adjacent the lower portion of the gate, means pivotally attaching the arm to the second connection portion of the link, a latch provided with a connection portion and an engagement portion, means pivotally attaching the connection portion of the latch to the intermediate connection portion of the link, a latch pin attached to the refuse container adjacent the lower portion thereof, the latch normally engaging the latch pin and securing the gate in closed position with respect to the refuse container, wherein the linearly operable fluid motor is operable to move the housing member and the actuator member one with respect to the other, such operation applying a force to the lever, such force pivotally moving the lever and pivotally moving the arm which is pivotally attached to the lever, the arm pivotally moving the link, the link pivotally moving the latch with respect to the latch pin, the force applied to the lever by the linearly operable fluid motor also pivotally moving the gate with respect to the refuse container, and wherein during movement of the lower portion of the gate toward the lower portion of the refuse container the arm is moved upwardly by pivotal movement of the lever and the arm pivotally moves the second connection portion of the link upwardly as the link pivotally moves about the first connection portion thereof and moves the connection portion of the latch upwardly for movement of the engagement portion of the latch into engagement with the latch pin, and wherein additional upward movement of the arm pivotally moves the second connection portion of the link farther upwardly and moves the connection portion of the latch farther upwardly, and the engagement portion of the latch applies a greater force upon the latch pin and urges the latch and the gate toward the refuse container and moves the lower portion of the gate into engagement with the lower portion of the refuse container.

6. The gate and latch mechanism of claim 5 which includes an abutment member attached to the gate adjacent the latch and engageable by the latch, wherein the latch engages the abutment member and pivots about the abutment member and the intermediate connection portion of the link as the engagement portion of the latch moves into engagement with the latch pin.

7. Gate operator and latch mechanism for a gate which closes an opening in a refuse container, the refuse container and the gate each having an upper portion and a lower portion, the upper portion of the gate being pivotally attached to the upper portion of the refuse container, comprising:

a lever pivotally attached to the gate adjacent the upper portion thereof, a linearly operable power unit pivotally attached to the refuse container, the power unit also being pivotally attached to the lever, a link provided with a plurality of spaced-apart connection portions, there being a first connection portion and a second connection portion, there being an intermediate connection portion which is generally between the first connection portion which is generally between the first connection portion and the second connection portion, the first connection portion of the link being pivotally attached to the gate adjacent the lower portion of the gate, an arm pivotally attached to the second connection portion of the link, the arm also being pivotally attached to the lever, the arm extending between the link and the lever, a latch having a connection portion and an engagement portion, the connection portion of the latch being pivotally attached to the intermediate connection portion of the link, a latch pin attached to the refuse container adjacent the lower portion thereof, abutment means carried by the gate adjacent the latch, the latch being adapted to engage the latch pin to secure the gate in closed position, the power unit being operable to pivotally move the lever, wherein the arm is moved generally axially with pivotal movement of the lever, and wherein the link is pivotally moved with movement of the arm, wherein the latch is pivotally moved by pivotal movement of the link, and wherein during movement of the lower portion of the gate toward the lower portion of the refuse container the arm is moved upwardly with pivotal movement of the lever and the arm moves the second connection portion of the link upwardly as the link pivotally moves about the first connection portion thereof and moves the connection portion of the latch upwardly, the engagement portion of the latch being moved downwardly with upward movement of the connection portion of the latch, as the latch pivots about the intermediate connection portion of the link, the engagement portion of the latch thus moving into engagement with the latch pin as the lower portion of the gate approaches the lower portion of the refuse container, and wherein additional upward movement of the arm moves the second connection portion of the link farther upwardly and the link moves the connection portion of the latch farther upwardly and the latch engages the abutment means and applies additional pressure upon the latch pin as the latch pivotally moves, and pivotal movement of the latch with respect to the latch pin forces movement of the lower portion of the gate into engagement with the lower portion of the refuse container.

8. The gate operator and latch mechanism of claim 7 in which the lever has a pair of opposed end portions and in which the lever is pivotally attached to the gate at a position intermediate the end portions of the lever, one of the members of the power unit being pivotally attached to one end portion of the lever, the arm being pivotally attached to the opposite end portion of the lever, and in which the link has a pair of opposed end portions, one of the end portions of the link being pivotally attached to the gate, the arm being pivotally attached to the opposite end portion of the link, the latch being pivotally attached to the link at a position intermediate the end portions thereof.

9. The gate operator and latch mechanism of claim 7 which includes a limit member adjacent the lever and engageable thereby to limit the pivotal movement of the lever.

10. The gate operator and latch mechanism of claim 7 which includes engagement means carried by the gate adjacent the latch and engageable by the latch to limit the pivotal movement of the latch.

* * * * *

UNITED STATES PATENT AND TRADEMARK OFFICE

CERTIFICATE OF CORRECTION

PATENT NO. : 4,665,649

DATED : May 19, 1987

INVENTOR(S) : Henry M. Hund, Jr.

It is certified that error appears in the above-identified patent and that said Letters Patent is hereby corrected as shown below:

Column 1, line 54, after "5" and before "fragmentary"

insert -- are --.

Column 7, delete line 38 line 39, delete "portion", (first occurrence).

Signed and Sealed this

Twenty-seventh Day of October, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,665,649

DATED : May 19, 1987

INVENTOR(S) : Henry M. Hund, Jr.

It is certified that error appears in the above-identified patent and that said Letters Patent is hereby corrected as shown below:

On the title page Item (73) Assignee: delete "Southern Railway, both of".

Signed and Sealed this

Second Day of February, 1988

*Attest:*

DONALD J. QUIGG

*Attesting Officer*

*Commissioner of Patents and Trademarks*